US007332662B2

(12) United States Patent
Kandrack et al.

(10) Patent No.: US 7,332,662 B2
(45) Date of Patent: Feb. 19, 2008

(54) STRINGED MUSICAL INSTRUMENT AND METHOD

(76) Inventors: Russell John Kandrack, Dark Guitars, 1862 Hillsdale Ave., Ambridge, PA (US) 15003; David Andrew Kandrack, Dark Guitars, 1862 Hillsdale Ave., Ambridge, PA (US) 15003

( * ) Notice: Subject to any disclaimer, the term of this patent is extended or adjusted under 35 U.S.C. 154(b) by 0 days.

(21) Appl. No.: 11/321,961

(22) Filed: Dec. 29, 2005

(65) Prior Publication Data

US 2006/0144208 A1 Jul. 6, 2006

Related U.S. Application Data

(60) Provisional application No. 60/639,943, filed on Dec. 30, 2004.

(51) Int. Cl.
*G10D 3/00* (2006.01)

(52) U.S. Cl. ..... 84/293

(58) Field of Classification Search ..... 84/267, 84/290, 291, 293

See application file for complete search history.

(56) References Cited

U.S. PATENT DOCUMENTS

| | | | | |
|---|---|---|---|---|
| 4,069,733 | A | 1/1978 | Quan | |
| 4,171,661 | A | 10/1979 | Rose | |
| 4,366,740 | A | 1/1983 | Tripp | |
| 5,922,979 | A * | 7/1999 | Yui | 84/291 |
| 6,300,549 | B1 | 10/2001 | Gregory | |
| 6,525,246 | B1 | 2/2003 | Erismann | |
| 6,563,032 | B2 | 5/2003 | Gregory | |
| 2003/0217634 | A1 | 11/2003 | Zigounakis | |
| 2004/0134330 | A1 * | 7/2004 | Braun et al. | 84/298 |
| 2004/0159204 | A1 | 8/2004 | Rose | |
| 2005/0098025 | A1 * | 5/2005 | Fussell | 84/737 |
| 2005/0150348 | A1 | 7/2005 | Ito | |
| 2005/0160897 | A1 | 7/2005 | Hirayama | |
| 2005/0204892 | A1 | 9/2005 | Minakuchi | |

OTHER PUBLICATIONS www.etribe.com, Jan. 2, 2004.*

* cited by examiner

*Primary Examiner*—Kimberly Lockett
(74) *Attorney, Agent, or Firm*—The Webb Law Firm

(57) ABSTRACT

The stringed musical instrument may be a guitar including a guitar body optionally defining a soundboard, an elongated neck extending from the guitar body and having a distal end, a headstock disposed at the distal end of the neck, and a plurality of strings each secured at a first end to the headstock and at a second end to the guitar body such that the strings overlay the neck and guitar body. The strings desirably pass through respective openings in the headstock and make physical contact with the headstock in the openings. The stringed musical instrument in one form may be a guitar, for example an electric guitar. The guitar body of the stringed musical instrument may be formed of wood and may optionally be of solid construction. A method of stringing a stringed musical instrument and a string tuning and clamping device for a stringed musical instrument are also disclosed.

27 Claims, 9 Drawing Sheets

STRINGED MUSICAL INSTRUMENT AND METHOD

CROSS REFERENCE TO RELATED APPLICATIONS

This application claims the benefit of U.S. Provisional Application No. 60/639,943, filed Dec. 30, 2004 and entitled "Dark Guitars System 1", the disclosure of which is incorporated herein in its entirety.

BACKGROUND OF THE INVENTION

1. Field of the Invention

The invention disclosed herein relates to the general field of musical instruments, especially stringed musical instruments having fretted necks such as guitars, basses, and mandolins and, more particularly to a system and method of securing strings to the musical instrument which allows the musician to alter the tonal sound characteristics of the stringed musical instrument.

1. Description of Related Art

Stringed musical instruments have been known for many thousands of years and include harps, violins (with fretless fingerboards), and guitars (with fretted fingerboards). When the string of a stringed instrument is plucked, it vibrates according to its harmonic modes and natural frequencies. The energy generated by the vibrating string is transmitted to the adjacent air and other parts of the musical instrument. A relatively recent development in stringed musical instruments is the electric guitar, invented by Les Paul, by which the vibration of metal strings is picked by magnetic pickups to create an electrical and/or electronic signal for amplification and processing. In modem music, electric guitars are one of the instruments of choice due to the dynamic range, portability, and artistic expression available through them. However, guitars are not the only stringed instruments which have been subject to electrification so that a wide variety of tuned, musically aligned, or coordinated stringed musical instruments are now available to the musical artist.

Virtually all of stringed musical instruments, acoustic or electric, include a main body part to which is attached at least one end of what is usually a plurality of strings. A neck is typically attached to the main body part along with the strings extending until they reach the longitudinal outer end thereof where they are fixed to the distal end of the neck, usually to some sort of tuning apparatus, in order to selectively apply tension to the strings. As indicated, sounds are produced by the musical instrument by plucking, or by strumming or bowing the strings which have been stretched between their points of attachment. Generally, the string and the qualities and characteristics of the instrument upon which the string is strung control the tonal related qualities for the instrument. The nature of the sound produced by the strings in particular is a function of many different variables and factors including the material of which the strings are made, the manner in which the strings are constructed, the length of the strings from their point of attachment on the main body part to their point of attachment at the distal end of the neck including whether there is any intermediate support between those two points of attachment, the amount of tension applied to the strings, the nature of the attachment of the strings to the body of the musical instrument and other factors.

Inventors have made efforts over the years to improve the mounted arrangement of strings on stringed musical instrument to improve the sound quality of the instrument and to enable the musician to generate new sounds and combination of sounds. One such mounting arrangement often used in electric guitars is a tremolo unit which allows the musician to alter an existing string tone or existing string tones by an increase or decrease in string tension. Examples of such tremolo units may be found in U.S. Pat. No. 4,171,661 to Rose and 3,916,729 to Burns et al. More recent examples of tremolo units may be found in U.S. Patent Application Publications Nos. 2005/0204892 and 2005/010897, as examples. Other inventors in this area have adapted guitar tailpieces/bridges to allow for adjustment in string tension. For example, U.S. Pat. No. 4,069,733 to Quan and 4,366,740 to Tripp disclose combined bridge and tailpiece structures for adjustment of string tension individually or in combination as disclosed by Quan. U.S. Patent Application Publication No. 2003/0217634 discloses a guitar having a "bendable" neck which allows the musician to alter the length of the guitar strings and, thus, affect string tension. U.S. Patent Application Publication No. 2005/0150348 discloses another string mounting arrangement consisting of an adjustable tailpiece for an electric guitar which permits the musician to selectively change string tension.

In another tract, U.S. Pat. No. 6,563,032 to Gregory discloses a multi-plane headstock to which the strings of a stringed musical instrument may be attached to control string tension and the angle at which the string breaks from the plane of the strings over the fingerboard. Other relevant innovations in the area of string mounting arrangements in stringed musical instruments include a removable nut assembly for quick release of tension in the strings as disclosed in U.S. Patent Application Publication No. 2004/0159204, and U.S. Pat. No. 6,525,246 to Erismann which discloses a travel guitar with as detachable body and neck structure that has the strings of guitar secured thereto.

In view of the foregoing, there is a need for system and method of adjusting string tension in a stringed musical instrument which allows instruments' tone to be adjusted over a wide range to suit the musician's preference and, further, which allows the string tension adjustment to be made quickly and easily.

SUMMARY OF THE INVENTION

The foregoing need is met by a stringed musical instrument constructed in accordance with the present invention. One feature of the invention is providing for the direct contact between the strings of the stringed musical instrument and the neck or headstock of the stringed musical instrument. In this embodiment, the stringed musical instrument comprises a guitar body optionally defining a soundboard, an elongated neck extending from the guitar body and having a distal end, a headstock disposed at the distal end of the neck, and a plurality of strings each secured at a first end to the headstock and at a second end to the guitar body such that the strings overlay the neck and guitar body. The strings desirably pass through respective openings in the headstock and make physical contact with the headstock in the openings.

The stringed musical instrument in one form may be a guitar, for example, an electric guitar. The guitar body of the stringed musical instrument may be formed of wood and may optionally be of solid construction.

The strings of the stringed musical instrument may each comprise an anchor fitting disposed on the first end for securing the strings in the respective openings in the headstock.

The stringed musical instrument may comprise a tuning and clamping device disposed on the guitar body to secure the second end of each of the strings. A bridge may be disposed on the guitar body forward of the tuning and clamping device and support the strings on the guitar body. Additionally, a tone control bar may be disposed on the guitar body forward of the tuning and clamping device and overlap the strings on the guitar body.

In view of the foregoing, another aspect of the invention is a method of stringing a stringed musical instrument. Such a method includes providing the stringed musical instrument, generally comprising a guitar body defining a soundboard, an elongated neck extending from the guitar body and having a distal end, and a headstock disposed at the distal end of the neck and defining a plurality of openings. The method further includes passing a plurality of strings through the respective openings in the headstock. The strings each may comprise a first end secured in the respective openings and a second end secured to the guitar body such that the strings overlay the neck and guitar body. The strings pass through the respective openings in the headstock and desirably make physical contact with the headstock in the respective openings.

Another step of in the method may include securing the second end of each of the strings in a tuning and clamping device disposed on the guitar body. The strings may be passed over a bridge disposed on the guitar body forward of the tuning and clamping device prior to securing the strings in the tuning and clamping device. Additionally, the strings may be passed under a tone control bar disposed on the guitar body forward of the tuning and clamping device prior to securing the strings in the tuning and clamping device. Optionally, the tone control bar may be overlaid on the strings forward of the tuning and clamping device and secured to the guitar body to locate the strings under the tone control bar. The method may further comprise adjusting tension in the strings using the tuning and clamping device to tune the strings.

Another aspect of the invention relates to a string tuning and clamping device for securing strings to a stringed musical instrument. Such a device includes a base adapted for affixation to the guitar body of a stringed musical instrument and defining recess, and a plurality of string anchors disposed in side-by-side relation in the recess and each adapted to receive and secure a string of the stringed musical instrument. The string anchors each comprise a lock block secured in the base and defining a groove for receiving a string of the stringed musical instrument, and a cap block cooperating with the lock block. The cap block comprises a depending tab adapted to seat in the groove to secure the string in the groove sandwiched between the tab and lock block. The groove may be tapered in a fore-aft direction of the lock block and the depending tab may be complimentary tapered to engage the tapered groove.

The lock block may be secured in the base by a tuning bolt passing through the lock block. The lock block may define an internally-threaded aperture accepting the tuning bolt for adjusting the forward-backward positioning of the string anchor in the recess to adjust string tension. The cap block may be secured to the lock block by mechanical fasteners.

Further details and advantages of the invention will become clear from the following detailed description when read in conjunction with the accompanying drawings.

DESCRIPTION OF THE PREFERRED EMBODIMENTS

Figure 1:
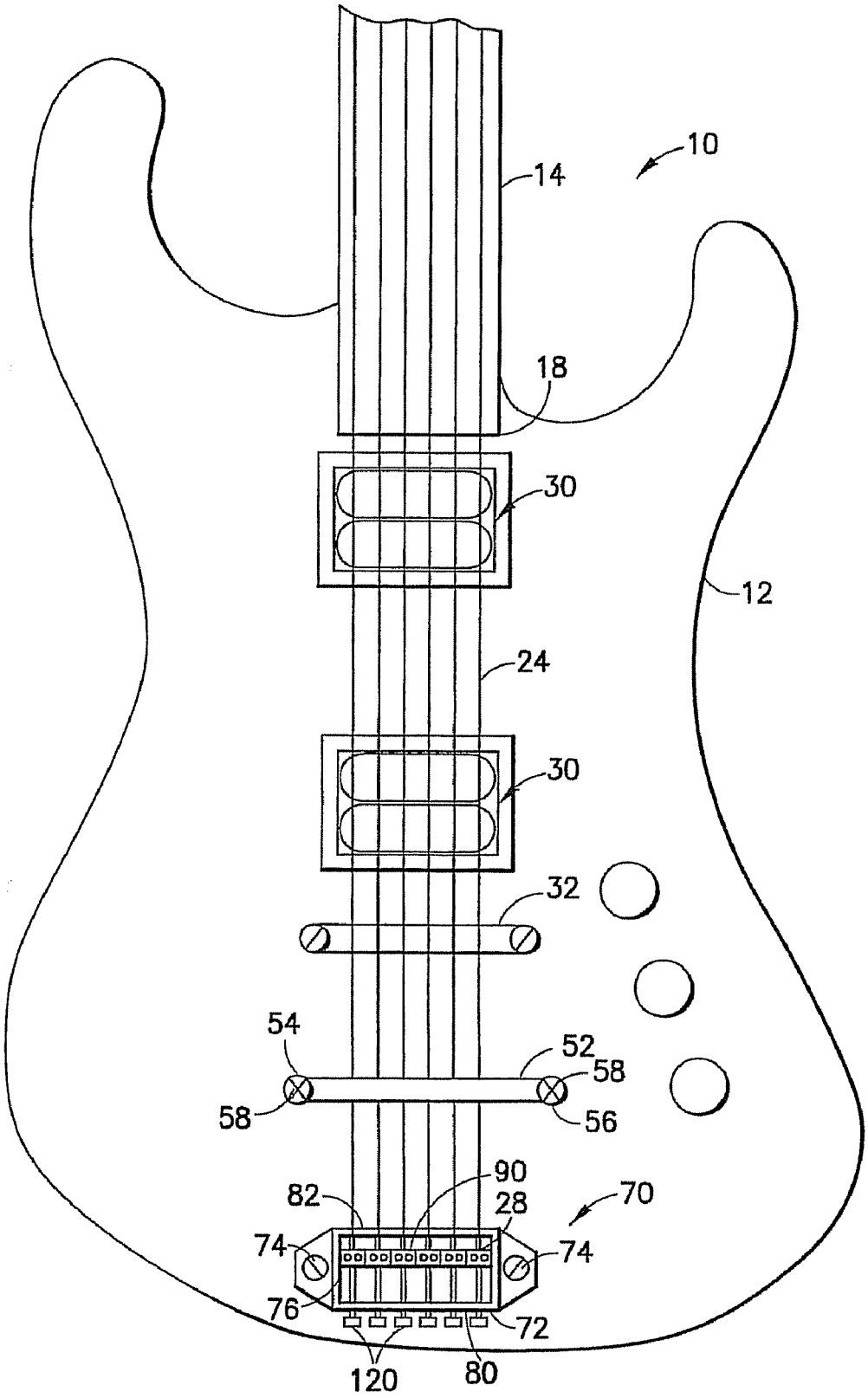
FIG. 1 is a top view of a stringed musical instrument in the form a guitar showing the guitar body and a proximal portion of the neck of the guitar.

For purposes of the description hereinafter, spatial orientation terms shall relate to the embodiments of the invention as it is oriented in the accompanying drawing figures or otherwise defined in the following description of the embodiments of the invention. However, it is to be understood that the embodiments described hereinafter may assume many alternative variations and embodiments except where expressly specified to the contrary. It is also to be understood that the specific devices and embodiments illustrated in the accompanying drawing figures and described herein are simply exemplary embodiments of the invention, and wherein like elements are designated with like reference numerals throughout.

Figure 2A:
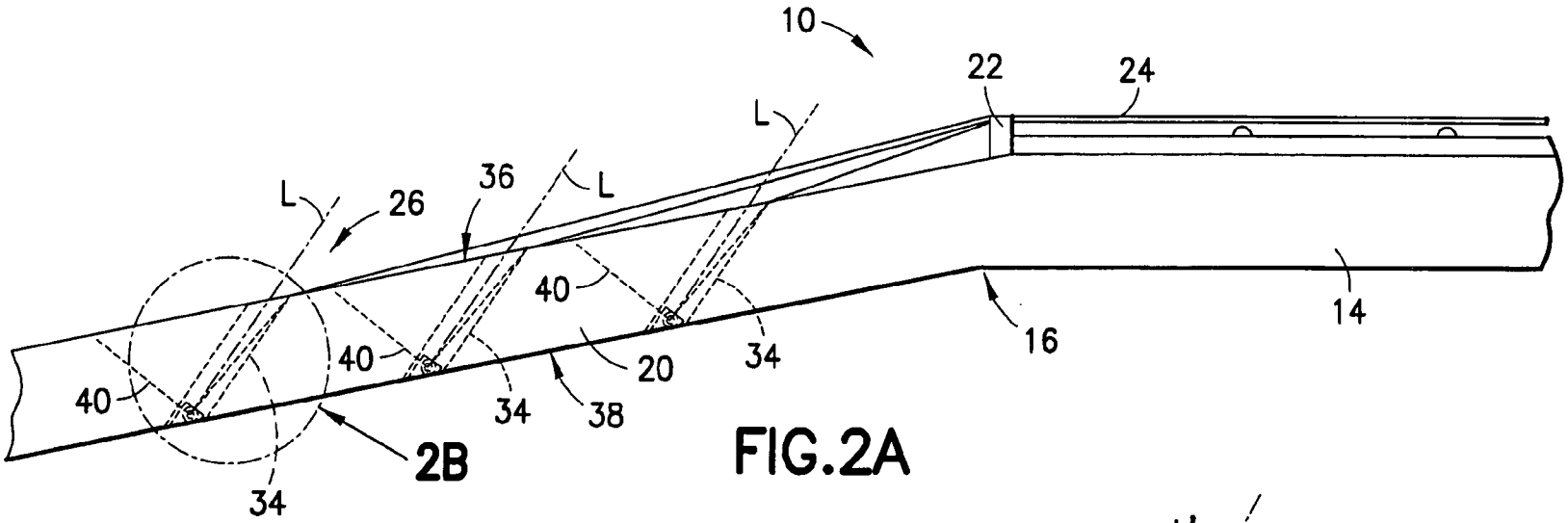
FIG. 2A is side view of a distal portion of the neck and a headstock of the guitar shown in FIG. 1.

For the remainder of the description, stringed musical instruments in general will be understood as being the general subject matter of the invention. However, for ease of discussion, reference may be made to a specific stringed musical instrument, such as a guitar 10, typically an electric guitar 10 as shown in the figures. This specific reference to an electric guitar 10 is not meant to limit the scope of the invention. As shown in FIGS. 1-3, guitar 10 generally includes a solid type body 12 optionally with a soundboard (not shown), a neck 14 extending forward or distally from the guitar body 12 and comprising a distal end 16 and a proximal end 18, and a headstock 20 disposed at the distal end 16 of neck 14. Guitar body 12 may be also be hollow or semi-hollow as is known in the art. Proximal end 18 of neck 14 is connected to guitar body 12. Neck 14 and guitar body 12 may optionally be integrally formed, or formed as separate structures with neck 14 thereafter being secured at proximal end 18 to guitar body 12. Guitar body 12, neck 14, and headstock 20 are typically made of wood. A nut 22 is located approximately at the distal end 16 of neck 14 just proximal or rearward of headstock 16. Nut 22 may be conventional and is provided on neck 14 such that strings 24 of guitar 10 can vibrate above neck 14 on headstock 20. Strings 24 each comprise a first or distal end 26 secured to headstock 20 and a second or proximal end 28 secured to guitar body 12 as described in detail herein.

Moving proximally or downward along guitar 10 from neck 14 to guitar body 12, pickups 30, which detect vibration of strings 24 and convert the vibration into electric signals, are located between the guitar body 12 and the strings 24. Pickups 30 are located below the proximal end 18 of neck 14. The electric signals converted by pickups 30 are transmitted to an amplifier via a cable (not shown) to be amplified and converted into sound as is conventional in the art. A bridge 32 is provided on guitar body 12 proximal of pickups 30 and forward of the anchoring location for strings 24 on guitar body 12. Bridge 32 may be conventional and support strings 24 on guitar body 12 of guitar 10 as is known in the art. Generally, strings 24 extend from nut 22 on neck 14 to bridge 32 on guitar body 12 such that the strings 24 are supported on neck 14 and guitar body 12. Typically, six strings 24 are provided on guitar 10 and contact nut 22 on neck 14, extend substantially parallel along neck 14 and onto guitar body 12, and are anchored on guitar body 12 as described herein. The distal end 26 of each string 24 is secured to headstock 20 as described herein. Each string 24 vibrates between nut 22 and bridge 32 when the guitar 10 is played. Tension in each string 24 may be adjusted to change the tone of the strings 24 by pulling or tensioning the strings 24 between headstock 20 and the anchoring location on guitar body 12. If desired, headstock 20 may be omitted and the first or distal end 26 of each string 24 secured to the distal end 16 of neck 14. In this variation, nut 22 may be located further down on neck 14.

As indicated, strings 24 are anchored at opposed ends 26, 28 to the headstock 20 and guitar body 12 of guitar 10, respectively. In contrast to conventional guitars, guitar 10 locates the tuning apparatus used to change tension in strings 24 on guitar body 12 of guitar 10 rather than on headstock 20 or at the distal end 16 of neck 14. Accordingly, the distal end 26 of each string 24 is secured to headstock 20 while the proximal end 28 of each string 24 is secured to guitar body 12. Headstock 20 is specifically adapted to secure the distal end 26 of each string 24. For this purpose, headstock 20 is formed with a plurality of openings 34 extending through headstock 20, typically transversely through headstock 20. As shown in FIG. 3, openings 34 may be arranged in a V-shaped configuration to facilitate separation between strings 24 and to orient strings 24 in a substantially parallel fashion on neck 14 and guitar body 12. This arrangement is merely exemplary and other arrangements, such as semicircular, for openings 34 may be substituted as long as the separation between strings 24 and their substantially parallel alignment is maintained. If headstock 20 is omitted as indicated previously, openings 34" may be provided at the distal end 16 of neck 14. Distal end 16 in such an alteration is indicated by dashed line 140 in FIG. 3, with openings 34" also in dashed lines.

Openings 34 are typically angled through headstock 20 from a top side 36 to a bottom side 38 of headstock 20. The central axis L of each opening 34 may define, for example, an angle of about 60° with the bottom side 38 of headstock 20. Although, this angle may also be in range of about 30° to 90°, with approximately 60° being presently preferred. Additionally, while openings 34 are illustrated in FIGS. 2A-2B as being angled toward neck 14, the openings 34 may also angled away from neck 14 and thus define an angle of greater than 90° with the bottom side 38 of headstock 20. Such an angle may be about 120°, as an example, or up to about 150° if desired. This alternative orientation of openings 34 is identified in FIG. 2A by dashed line 40, which represents an angle of about 150° between the central axis L of each opening 34 and the bottom side 38 of headstock 20.

As shown in detail in FIG. 2B, in one embodiment, each opening 34 may accommodate a bushing or insert 42 inserted into the opening 34 through the bottom side 38 of headstock 20. Such a bushing or insert 42 includes an outward extending lip 44 to engage the bottom side 38 of headstock 30. The bushing or insert 42 may be secured in opening 34 via a friction fit, adhesive, or other methods customary in the art. The bushing or insert 42 defines a constricted area 46 in opening 34 adjacent the bottom side 38 of headstock 20. This constricted area 46 accommodates a bead shaped anchor fitting 48 provided on the first or distal end 26 of each string 24. Such bead shaped anchor fittings 48 are conventional in the art and commonly used to secure guitar strings to guitar bodies. Strings 24 each pass through openings 34 from bottom side 38 to top side 36 of headstock 20, and desirably make contact with the body of headstock 20 in the respective openings 34. For example, as shown in FIG. 2B, the first end 26 of string 24 is secured in constricted area 46 by interference engagement between anchor fitting 48 and bushing or insert 42. String 24 passes through an opening 49 in the bottom of bushing 42 and extends through the length of opening 34. As string 24 approaches the top side 36 of headstock 20, tension applied to string 24 causes string 24 to angle away from the central axis L of opening 34 and contact the body of headstock 20. As the body of headstock 20 is typically made of wood, string 24 contacts the wood forming headstock 20 in opening 34, generally at or near the top side 36 of headstock 20. Thus, string 24 is in intimate contact with the material forming the headstock 20 in opening 34, approximately at the top side 36 of headstock 20. This contact point or area is generally represented in FIG. 2B by reference numeral 50. Contact is desirably provided between the strings 24 and headstock 20 in openings 34, as indicated previously. However, if desired an insert may be provided in each opening 34 so that the contact between strings 24 and headstock 20 is through such an insert. Accordingly, in this disclosure the term "physical contact" between strings 24 and headstock 20 is intended to encompass even indirect physical contact through inserts provided in the respective openings 34.

Figure 2C:
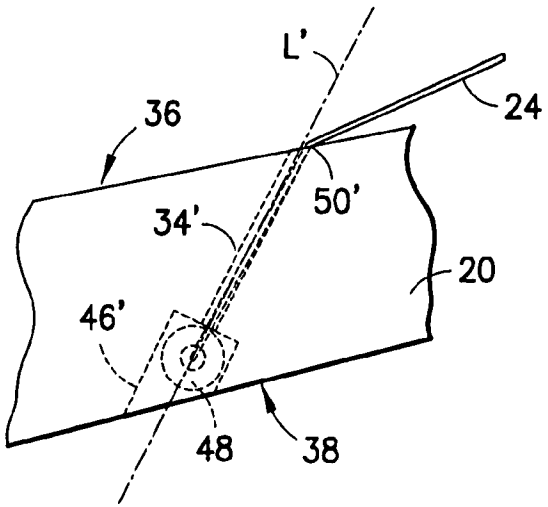
FIG. 2C is detail view of an alternative embodiment of the string opening shown in FIG. 2B.
Figure 2B:
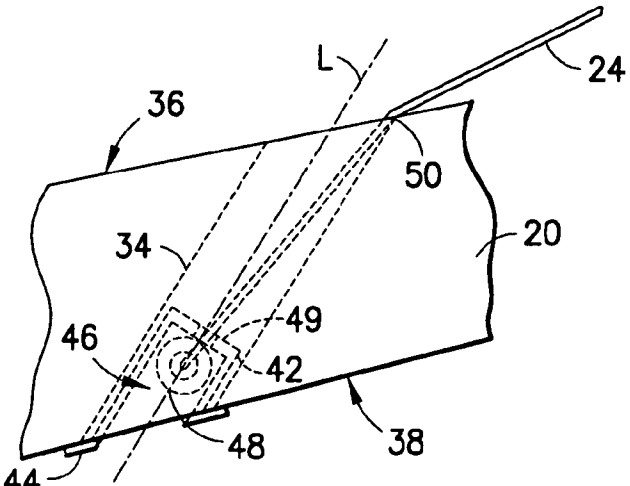
FIG. 2B is a detail view of detail 2B in FIG. 2A illustrating a string opening through the headstock.
Figure 3:
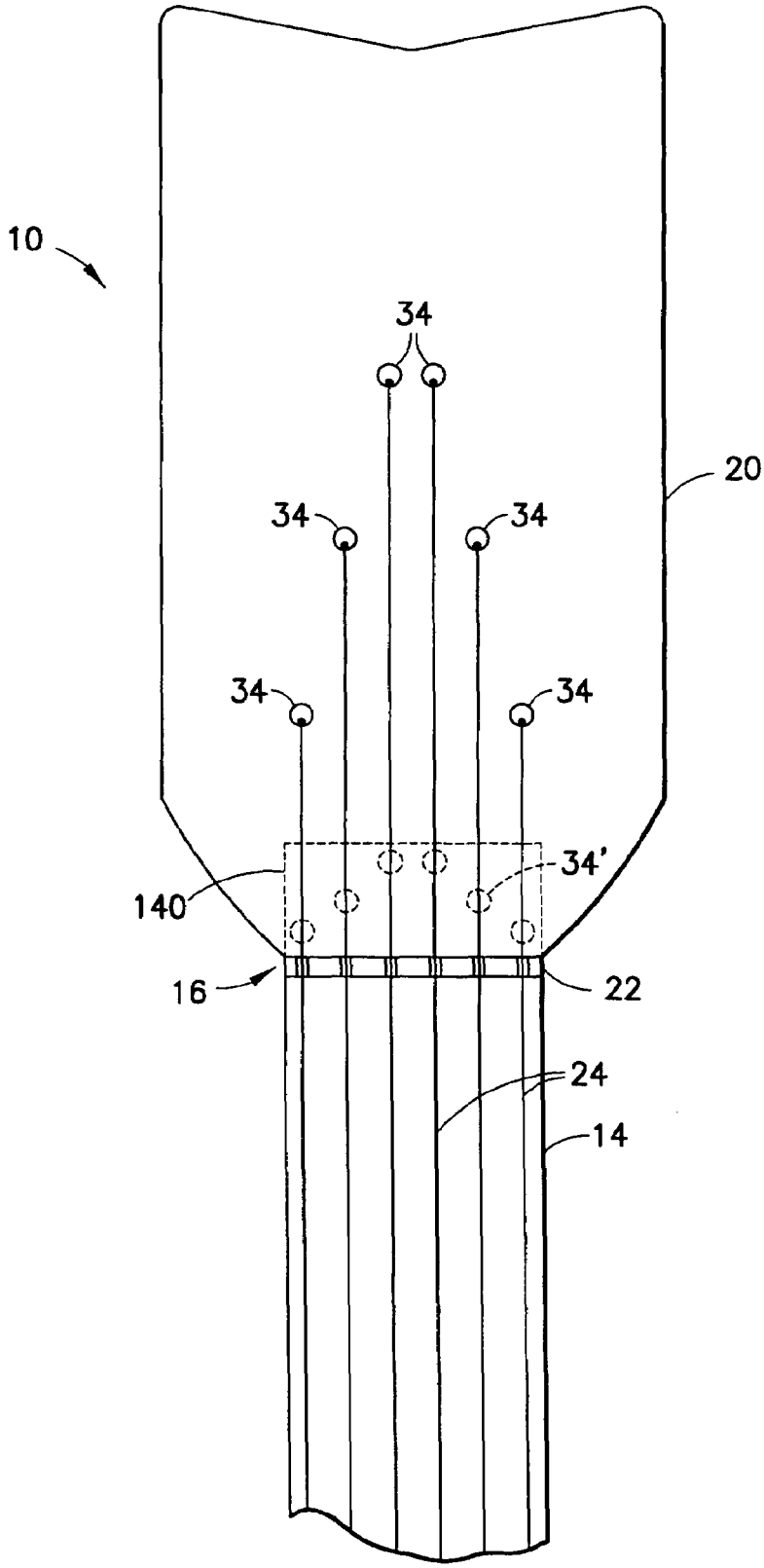
FIG. 3 is a top view of the distal portion of the neck and the headstock of the guitar shown in FIG. 1.
Figure 4:
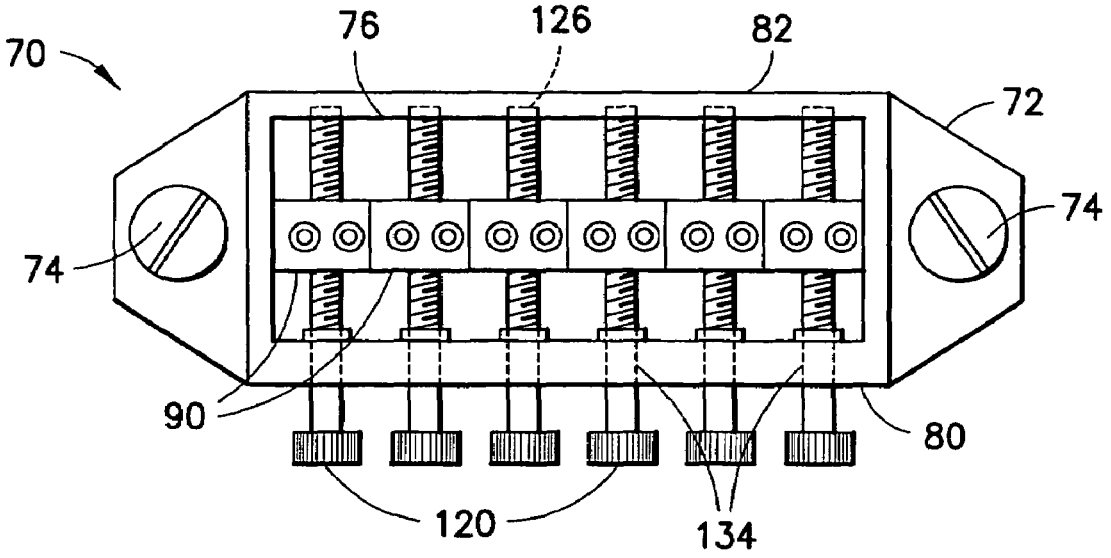
FIG. 4 is a top view of a tuning and clamping device used in the guitar shown in FIG. 1.

FIG. 2C illustrates an alternative configuration of opening 34' in headstock 20. In FIG. 2C, opening 34' has a smaller diameter than opening 34' shown in FIG. 2B. The diameter of opening 34' is approximately equal to or slightly larger than string 24. As a result, as string 24 passes through the length of opening 34', the length of string 24 within opening 34' may contact the wall of opening 34' wholly or partially along its length and, thus, be in intimate contact with the body (and wooden material) of headstock 20 in opening 34'. However, string 24 maintains a similar or slightly enlarged contact point or area 50' with headstock 20 in opening 34', as in the configuration of opening 34 shown in FIG. 2B, due to the tension applied to string 24. Constricted area 46' is shown in FIG. 2C as having a larger diameter than opening 34 and forms a "receiving" bore or recess for anchor fitting 48 on string 24. In this embodiment, receiving bore or recess 46' is in actuality a countersunk area or portion in opening 34' defined at the bottom side 38 of headstock 20. String 24 also typically defines a slightly angled path in opening 34' away from central axis L of opening 34' to contact the body of headstock 20 at contact point or area 50'. However, contact point or area 50' may now encompass more of the inner wall of opening 34' than in the configuration illustrated in FIG. 2B, as previously indicated. Receiving bore or recess 46' secures anchor fitting 48 in opening 34' in the manner discussed previously (i.e., interference engagement). While opening 34' is shown in FIG. 2C with a relatively small diameter approximately equal to or slightly larger than string 24, opening 34' may have a larger diameter in the manner of the opening 34 shown in FIG. 2B, as long as the diameter of opening 34' remains less than the diameter of anchor fitting 48 on the first or distal end 26 of string 24.

Figure 12A:
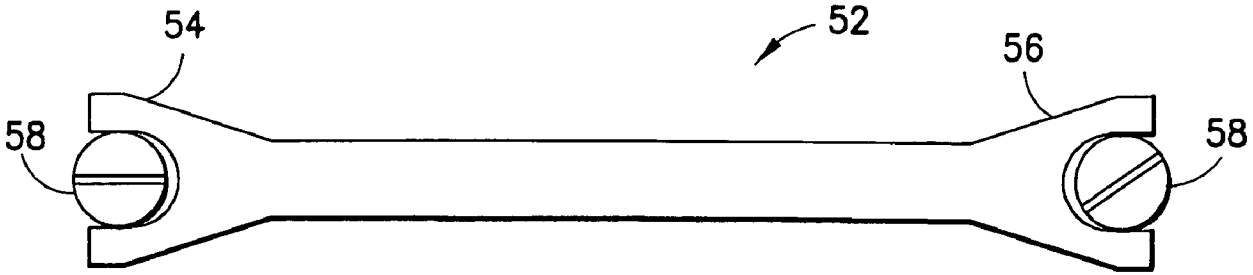
FIGS. 12A-12B are plan and side views, respectively, of a tone control bar used in the guitar shown in FIG. 1.
Figure 12B:
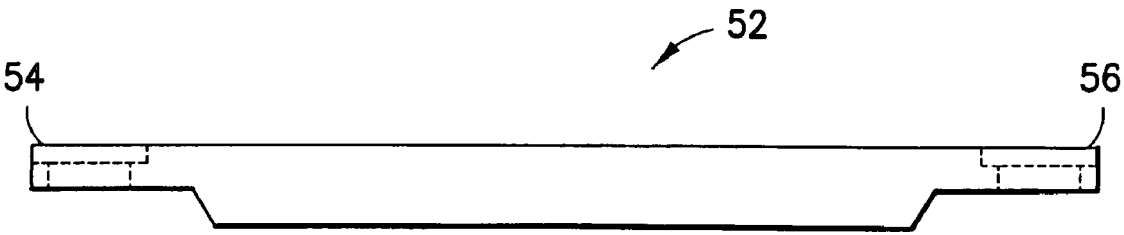
Figure 12C:
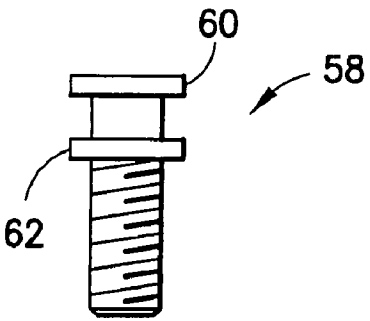
FIG. 12C is a side view of a fastener used to affix the tone control bar shown in FIGS. 12A-12B to the guitar body shown in FIG. 1.

With the securing arrangement for strings 24 on headstock 20 described, attention is now turned to the arrangement for securing the second or proximal end 28 of strings 24 to body 12, and the tuning arrangement for tuning strings 24. With continued reference to FIGS. 1-3 and further reference to FIGS. 12A-12C, a tone control bar 52 is provided on body 12 proximal of bridge 32. Tone control bar 52 is generally an elongated bar structure made of metal such as steel with ends 54, 56 adapted to be secured to the guitar body 12 via mechanical fasteners 58 (i.e., bolts). Fastener bolts 58 are of such construction that they may be manipulated to raise or lower the tone control bar 52 relative to the guitar body 12. Fastener bolts 58 may cooperate or engage internally threaded base bushings (not shown) inserted or residing in the guitar body 12 and which are ideally adapted to be resistant to rotation in guitar body 12. Fastener bolts 58 are formed with bolt heads 60 and disks 62 formed below heads 60. Disks 62 may be placed on fastener bolts 58 or be formed integrally with fastener bolts 58. The spacing between heads 60 and disks 62 on the fastener bolts 58 is sized to accept the ends 54, 56 of tone control bar 52. As described further herein, strings 24 generally pass over bridge 32 and under tone control bar 52 on guitar body 12 and the vertical adjustment of tone control bar 52 on guitar body 12 may be controlled by fastener bolts 58 to change the tone of the strings 24. In particular, by increasing or decreasing the tension in strings 24 over the bridge 32 by changing the vertical positioning of tone control bar 52, the tone of the strings 24 may be changed, with a decrease in tension over bridge 32 corresponding to higher vertical position of tone control bar 52 relative to guitar body 12 creating a warmer, rich tone and an increase in tension over bridge 32 corresponding to lower vertical position of tone control bar 52 relative to guitar body creating a bright, crisp tone.

Referring additionally to FIGS. 4-11, strings 24 are secured at their second or proximal ends 28 to a fully tunable tuning and clamping device 70, hereinafter "device 70" for expediency in explaining this component. Device 70 is a multi-component mechanism serving to both retain the second end 28 of each string 24 and allow the musician to adjust string tension and, thereby, the tonal qualities of the string 24. Device 70 comprises a base element or plate 72, typically made of metal such as steel, adapted for affixation to the guitar body 12, typically by mechanical fasteners 74 (i.e., bolts). Fasteners 74 may cooperate or engage bushings similar to those described previously in connection with the fastener bolts 58 used to affix tone control bar 52 to guitar body 12. Alternatively, fasteners 74 may be self-tapping screws for more permanently affixing base 72 to guitar body 12. Base 72 defines a recessed area or cavity 76 that is generally rectangular in shape. Recess 76 is provided to accommodate a plurality of string clamping devices, one for each of the six strings 24 of guitar 10, as described herein. As shown, for example, in FIG. 5, a top end or side 78 of base 72 is generally tapered from a high point at a rearward or proximal end wall 80 of base 72 to a lower point at a front or distal end wall 82 of base 72. Thus, base 72 generally tapers downward from rear to front. The top end or side 78 of base 72 is convexly chamfered (i.e., rounded) at the distal end wall 82 of the base 72 so as not to interfere with the strings 24 passing to the string clamping devices described herein. The convex chamfering of base 72 at distal end wall 82 is identified generally with reference numeral 84.

Figure 5:
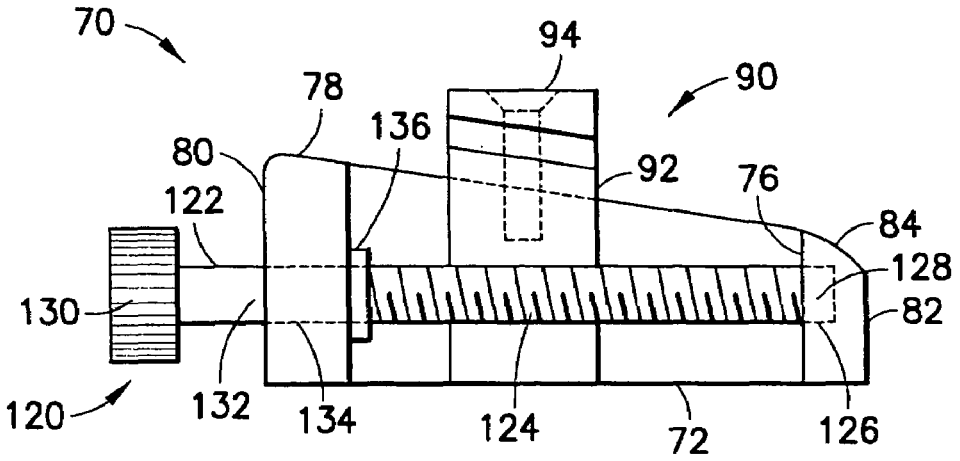
FIG. 5 is a side view of the tuning and clamping device of FIG. 4.
Figure 7:
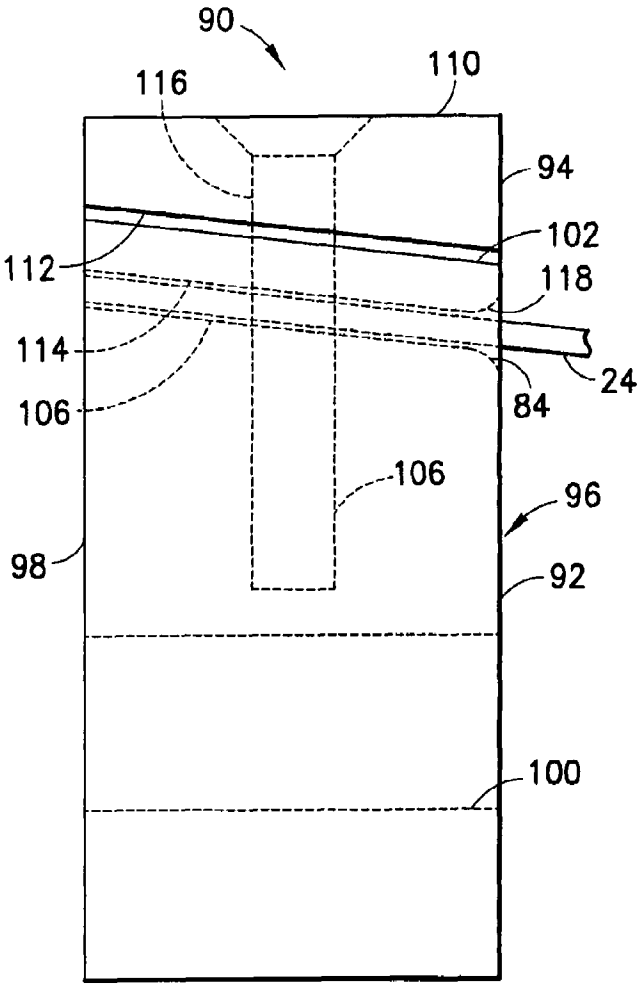
FIG. 7 is a side view of the string anchor shown in FIG. 6.
Figure 6:
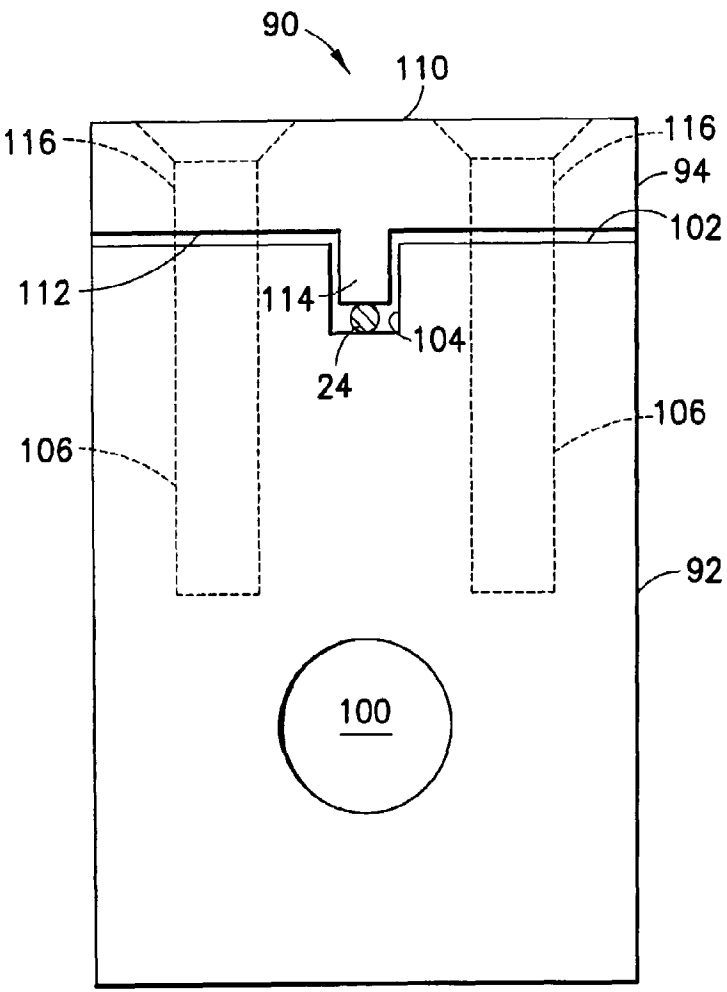
FIG. 6 is a front view of a string anchor used in the tuning and clamping device of FIG. 4.
Figure 9:
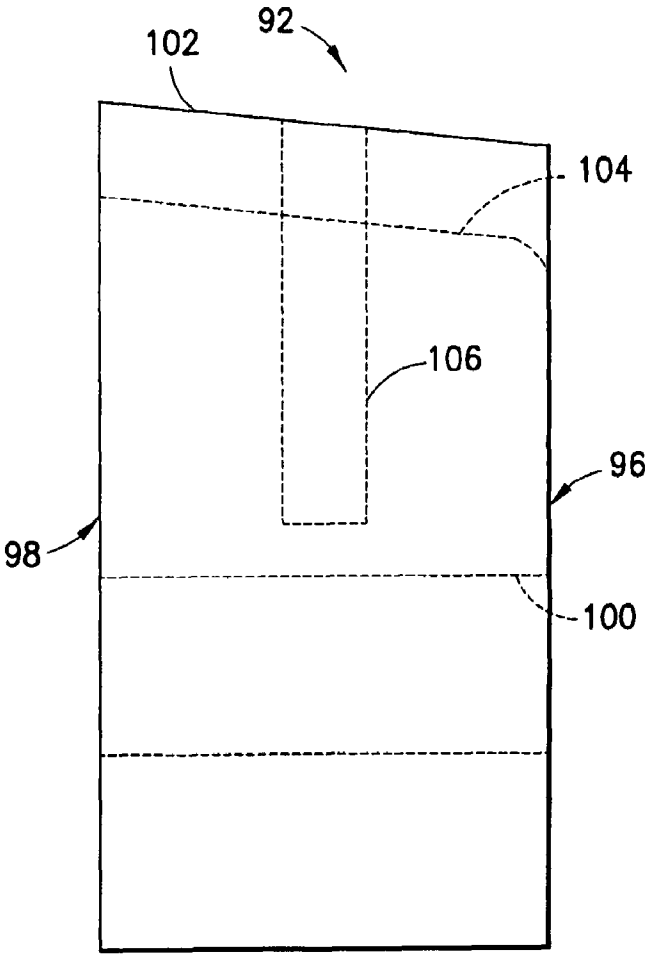
FIG. 9 is a side view of the lock block shown in FIG. 8.
Figure 8:
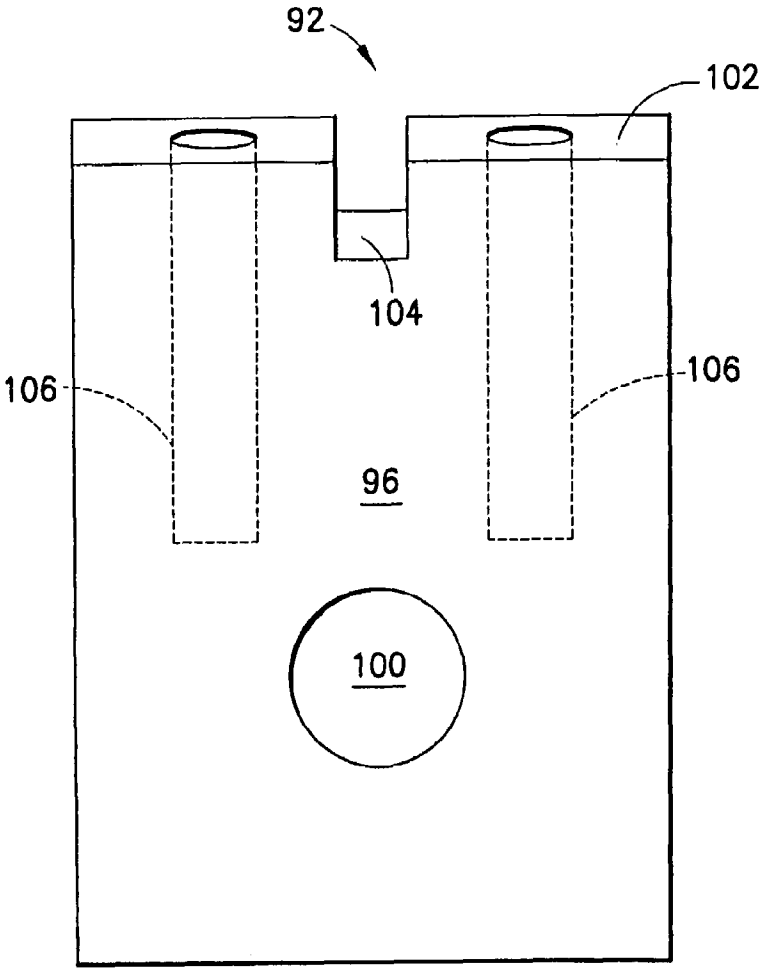
FIG. 8 is a front view of a lock block used in the string anchor shown in FIGS. 6-7.

As indicated, each string 24 is secured by a string clamping device or anchor 90 disposed within base 72. The plurality of string anchors 90 is disposed in side-by-side relation in the recess 76 in base 72, with each string anchor 90 adapted to receive and secure one string 24 of the guitar 10. Generally, each string anchor 90 is comprised of a lock block 92 adapted to be secured to the base 72 and a cap block 94 adapted to cooperate with the lock block 92 and be secured thereto. Lock block 92 and cap block 94 are typically formed of metal but may also be made of wood. Lock block 92 is a generally rectangular structure having a forward end 96 and a rearward end 98 thereby defining a fore-aft direction of the lock block 92. Lock block 92 defines a central aperture 100 extending through lock block 92 in the fore-aft direction for accepting a fastener used to secure lock block 92 to base 72, adjusting the fore-aft positioning of lock block 92 in recess 76 and, thereby, for tuning string 24 secured by string anchor 90. Central aperture 100 is typically internally threaded to accept and externally threaded securing and tuning fastener (i.e., bolt or screw) as described herein. A top end or side 102 of lock block 92 defines a generally centrally located groove 104 also extending in the fore-aft direction of lock bock 82 and which is adapted to accommodate or receive one of the strings 24 of guitar 10. Top end or side 102 and, further, groove 104 of lock block 92 are each typically tapered to match the forward taper of the top end or side 78 of base 72. As shown in FIG. 5, for example, the top end or side 102 of lock block 92 is positioned or extends above the top end or side 78 of base 72, but extends in a plane generally parallel to the top side 78 of base 72. The tapering of the top ends or sides 102, 78 of lock block 92 and base 72, respectively, may be in the range of 10°-30°, and even up to about 45°. Groove 104 may exhibit similar tapering. Lock block 92 further defines two vertical apertures 106 for accepting fasteners (i.e., bolts) 108 used to secure cap block 94 to lock block 92. Accordingly, in one possible embodiment, vertical apertures 106 may be internally threaded to engage externally threaded fasteners 108. Apertures 106 extend approximately transverse to central aperture 100.

Figure 10A:
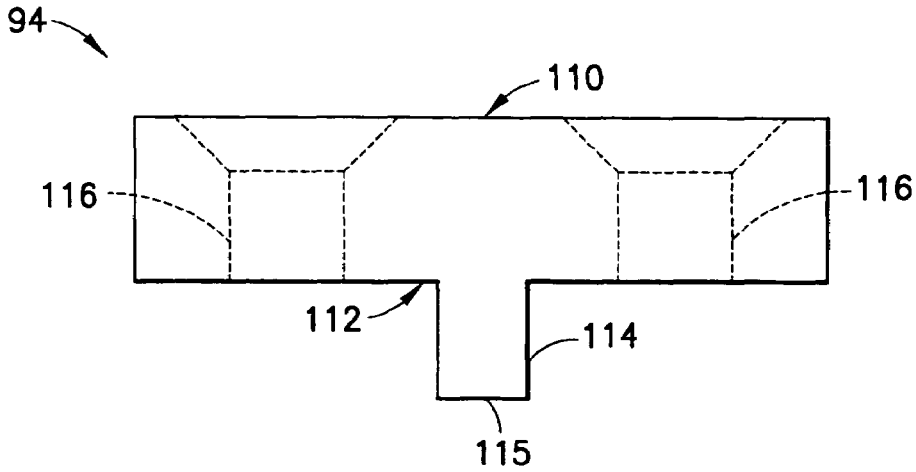
FIGS. 10A-10C are front, side, and rear views, respectively of a cap block used in the string anchor shown in FIGS. 6-7.
Figure 10B:
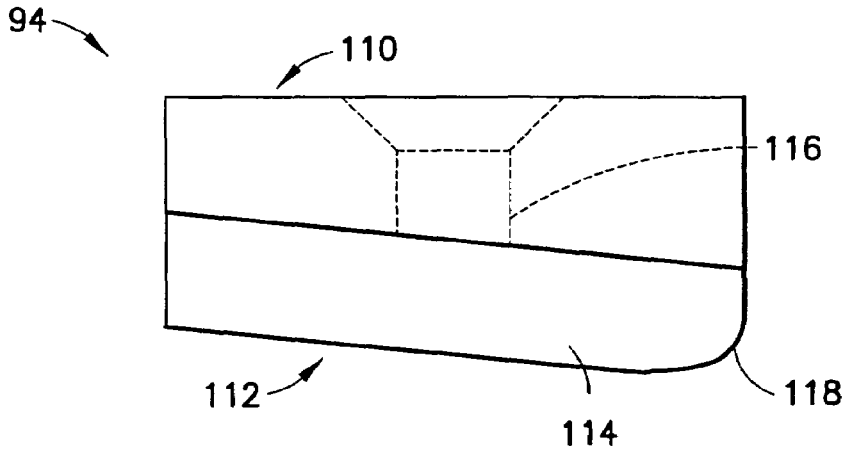
Figure 10C:
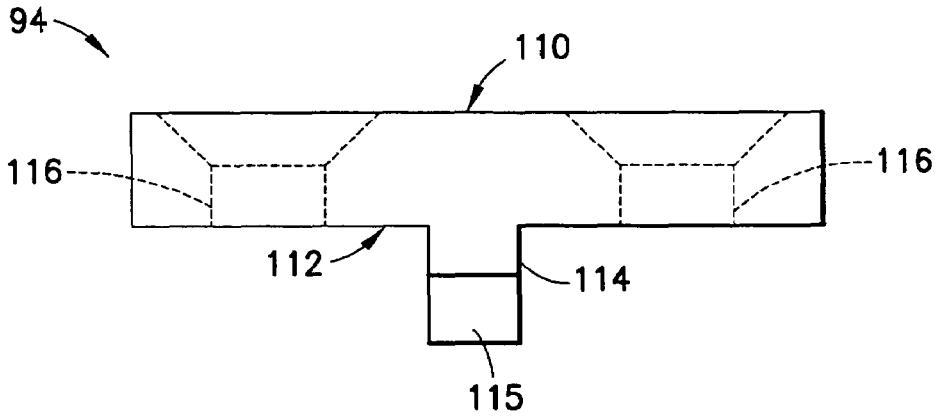
Figure 11:
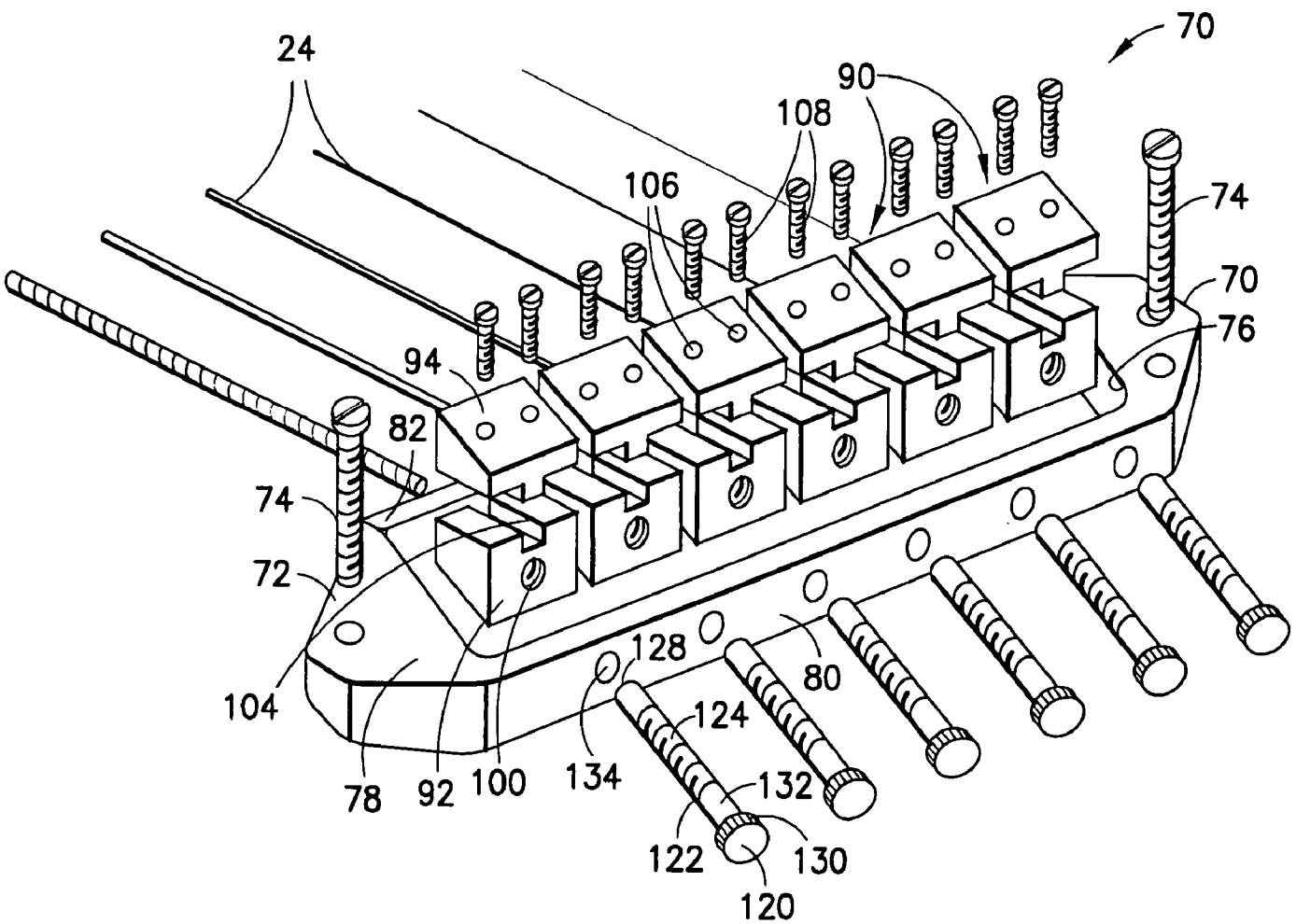
FIG. 11 is an exploded perspective view of the tuning and clamping device shown in FIG. 4.

Cap block 94 generally comprises a top side or end 110 and a bottom side or end 112. Top side 110 of cap block 94 is generally planar or flat and un-tapered. A depending tab 114 extends from bottom side 112 and is adapted to seat in or engage groove 104 to secure string 24 in groove 104 in a sandwiched configuration between the depending tab 114 and lock block 92. Cap block 94 generally has the rectangular dimensions of lock block 92. Since the top end or side 102 of lock block 92 and groove 104 are tapered, the bottom side 112 of cap block 94 and a bottom surface or end 115 of depending tab 114 are preferably complimentary tapered to allow engagement between the bottom side 112 of cap block 94 and the top side 102 of lock block 92 and, further, proper cooperating engagement between the depending tab 114 and groove 104. Accordingly, cap block 94 exhibits the reverse tapering from lock block 92 (i.e., frontward to rearward in the fore-aft direction). Cap block 94 further defines vertical apertures 116 formed to coincide with the vertical apertures 106 in lock block 92 so that fasteners 108 may be inserted though vertical apertures 116 in cap block 94 and engage the vertical apertures 106 in lock block 92. Typically, threaded bolts are used for fasteners 108. Thus, in use, fasteners 108 are inserted through typically unthreaded vertical apertures 116 in cap block 94 and threadedly engage the internally threaded vertical apertures 106 in lock block 92 to secure cap block 94 to underlying lock block 92. As shown in FIG. 10B, for example, depending tab 114 is convexly chamfered (i.e., rounded) at its forward or distal end so as not to interfere with the string 24 passing to the string anchor 90. The convex chamfering of depending tab 114 at its forward or distal end is identified generally with reference numeral 118.

The lock block 92 of each string anchor 90 is secured in recess 76 in base 72 by a tuning bolt 120 passing through the central aperture 100 in lock block 92. Typically, tuning bolt (or screw) 120 comprises a shaft 122 that is externally threaded along a portion 124 of its length. Threaded portion 124 of shaft 122 threadedly engages central aperture 100 in lock block 92. Accordingly, rotation of tuning bolt 120 will cause forward or backward (fore-aft) movement of lock block 92 and, hence string anchor 90, in recess 76 in base 72, and thereby change the tension in the string 24 secured between cap block 94 and lock block 92, as described further herein. As string tension is adjusted, the tonal sounds produced by string 24 will also change, allowing the musician to tune guitar 10 as desired. Lock block 92 is physically secured to base 72 by the tuning bolt 120 engaging the forward or distal end wall 82 and rear or proximal end wall 80 of base 72. Specifically, a cavity or recess 126 is defined in the distal end wall 82 to receive a distal end or tip 128 of tuning bolt 120. As tuning bolt 120 is intended to rotate relative to base 72, distal tip 128 of tuning bolt 120 is journaled or received for rotation in cavity 126. Tuning bolt 120 also comprises a textured tuning head 130 which allows the musician to easily rotate tuning bolt 120 and thereby adjust the positioning of string anchors 90 in base 72. A proximal end or portion 132 of tuning bolt 120 is also preferably unthreaded in a similar manner to distal tip 128, and extends through a rear opening 134 in the rear or proximal end wall 80 of base 72. Proximal portion 132 of tuning bolt 120 is fully rotatable in rear opening 134. A disk structure 136 may be provided on tuning bolt 120 proximal of threaded portion 124, if desired, to prevent or inhibit removal of tuning bolt 120 from base 72 and, further, facilitate rotation of tuning bolt 120 in base 72.

With the components of guitar 10 now described, the affixing of strings 24 to guitar 10 will now be described with continued reference to all the figures. To attach strings 24 to guitar 10, the musician typically begins by passing the proximal ends 28 of strings 24 through the respective openings 34 in the headstock 20 from the bottom side 38 of the headstock 20 until the anchor fittings 48 provided at the first of distal end 26 of each string 24 engages the constricted area (or receiving bore) 46, 46' in each opening 34. The strings 24 are then overlaid on the neck 14 and guitar body 12 and specifically on top of bridge 32 on guitar body 12. The musician may then either pass the strings 24 under the tone control bar 52, if previously affixed to guitar body 12 and then secure the second or proximal end 28 of each string 24 to the tuning and clamping device 70, or affix the tone control bar 52 over the strings 24 after the second end 28 of each string 24 has been secured in the tuning and clamping device 70.

The musician affixes the second end 28 of each string 24 in the tuning and clamping device 70 in the manner described hereinafter. Since the procedure for securing one of the strings 24 in one of the string anchors 90 is the same for all strings 24, the following discussion will describe the attachment of one string 24 to one string anchor 90 for brevity. The selected string anchor 90 is placed in a state ready to accept string 24 by typically unthreading fasteners 108 in vertical apertures 106 in lock block 92 so that cap block 94 may be spaced a short vertical distance from (i.e., above) lock block 92. This simultaneously lifts depending tab 114 from engagement with groove 104 and permits the musician to insert the string 24 into groove 104 in lock block 92. The proximal end 28 of string 24 may be pulled taught with hand pressure and the fasteners 108 may be rotated to effect threaded engagement in vertical apertures 106. This rotation causes cap block 94 to engage or seat against lock block 92 and, further, causes depending tab 114 to engage groove 104 and sandwich string 24 between tab 114 and lock block 92. Sufficient pressure is applied on string 24 to secure string 24 in groove 104 by frictional engagement. Excess string 24 extending from the rearward end 98 of lock block 92 may be trimmed off.

The musician may then tune the string 24 by rotation of tuning bolt 120. Tuning bolt 120 and central aperture 100 in lock block 92 preferably use a conventional thread pitch construction where clockwise rotation of tuning head 130 results in rearward or backward movement of lock block 92 and, hence string anchor 90, in recess 76, and counterclockwise rotation results in forward or distal movement of lock block 92 and, hence string anchor 90, in recess 76. Accordingly, clockwise movement of tuning bolt 120 results in a rearward movement of string anchor 90 in recess 76 and a slight elongation of string 24 and increased tension in string 24, thereby raising the pitch of string 24. In contrast, counterclockwise movement of tuning bolt 120 results in a forward movement of string anchor 90 in recess 76 and a slight shortening of string 24 and decreased tension in string 24, thereby lowering the pitch of string 24.

While the stringed musical instrument of this invention was described with reference to a guitar and several distinct features thereof, those skilled in the art may make modifications and alterations to this invention without departing from the scope and spirit of the invention. Accordingly, the foregoing description is intended to be illustrative rather than restrictive. The described guitar provides for direct contact or engagement between the strings and the material (i.e., wood) of the headstock or neck. This arrangement will increase the guitars sustain and note articulation by transmitting string vibration from the neck back to the strings. By incorporating the tone control bar, the guitar's tone may be adjusted over a wide range, from a rich warm tone to a bright crisp tone, to suit the musician's preference. The fully tunable tuning and clamping device provides for easy securing and tuning of the strings. The invention described hereinabove is defined by the appended claims, and all changes to the invention that fall within the meaning and the range of equivalency of the claims are embraced within their scope.

We claim:

1. A stringed musical instrument, comprising:

an instrument body;

an elongated neck extending from the instrument body and having a distal end;

a headstock disposed at the distal end of the neck; and a plurality of strings each secured at a first end to the headstock and at a second end to the instrument body such that the strings overlay the neck and instrument body;

wherein the strings pass through respective openings in the headstock and make direct physical contact with the headstock in the openings, and the openings having no tuning hardware present therein.

2. The stringed musical instrument as claimed in claim 1, wherein the stringed musical instrument comprises a guitar.

3. The stringed musical instrument as claimed in claim 2, wherein the guitar comprises an electric guitar.

4. The stringed musical instrument as claimed in claim 1, wherein the instrument body is formed of wood.

5. The stringed musical instrument as claimed in claim 1, wherein the strings each comprise an anchor fitting disposed on the first end for securing the strings in the respective openings in the headstock.

6. The stringed musical instrument as claimed in claim 1, comprising a tuning and clamping device disposed on the instrument body and securing the second end of each of the strings.

7. The stringed musical instrument as claimed in claim 6, comprising a bridge disposed on the instrument body forward of the tuning and clamping device and supporting the strings on the instrument body.

8. The stringed musical instrument as claimed in claim 6, comprising a tone control bar disposed on the instrument body forward of the tuning and clamping device and overlapping the strings on the instrument body.

9. The stringed musical instrument as claimed in claim 1, wherein the instrument body comprises a solid instrument body formed of wood.

10. A method of stringing a stringed musical instrument, comprising:

providing the stringed musical instrument comprising:

an instrument body;

an elongated neck extending from the instrument body and having a distal end; and a headstock disposed at the distal end of the neck and defining a plurality of openings; and passing a plurality of strings through the respective openings in the headstock, the strings each comprising a first end secured in the respective openings and a second end secured to the instrument body such that the strings overlay the neck and instrument body;

wherein the strings pass through the respective openings in the headstock and make direct physical contact with the headstock in the respective openings, and the openings having no tuning hardware present therein.

11. The method as claimed in claim 10, comprising securing the second end of each of the strings in a tuning and clamping device disposed on the instrument body.

12. The method as claimed in claim 11, comprising passing the strings over a bridge disposed on the instrument body forward of the tuning and clamping device prior to securing the strings in the tuning and clamping device.

13. The method as claimed in claim 11, comprising passing the strings under a tone control bar disposed on the instrument body forward of the tuning and clamping device prior to securing the strings in the tuning and clamping device.

14. The method as claimed in claim 11, overlaying a tone control bar on the strings forward of the tuning and clamping device and securing the tone control bar to the instrument body.

15. The method as claimed in claim 11, comprising adjusting tension in the strings using the tuning and clamping device to tune the strings.

16. A string tuning and clamping device for a stringed musical instrument, comprising:

a base adapted for affixation to the instrument body of a stringed musical instrument and defining a recess; and a plurality of string anchors disposed in side-by-side relation in the recess and each adapted to receive and secure a string of the stringed musical instrument, the string anchors each comprising:

a lock block secured in the base and defining a groove for receiving a string of the stringed musical instrument; and a cap block cooperating with the lock block, the cap block comprising a depending tab adapted to seat in the groove to secure the string in the groove sandwiched between the tab and lock block.

17. The string tuning and clamping device as claimed in claim 16, wherein the lock block is secured in the base by a tuning bolt passing through the lock block.

18. The string tuning and clamping device as claimed in claim 17, wherein the lock block defines an internally-threaded aperture accepting the tuning bolt for adjusting the forward-backward positioning of the string anchor in the recess to adjust string tension.

19. The string tuning and clamping device as claimed in claim 16, wherein the cap block is secured to the lock block by mechanical fasteners.

20. The string tuning and clamping device as claimed in claim 16, wherein the groove is tapered in a fore-aft direction of the lock block and wherein the depending tab is complimentarily tapered to engage the tapered groove.

21. A stringed musical instrument, comprising:

an instrument body;

an elongated neck extending from the instrument body and having a distal end;

a headstock disposed at the distal end of the neck;

a plurality of strings each secured at a first end to the headstock and at a second end to the instrument body such that the strings overlay the neck and instrument body; and a string tuning and clamping device disposed on the instrument body comprising:

a base adapted for affixation to the instrument body and defining a recess; and a plurality of string anchors disposed in side-by-side relation in the recess and each adapted to receive and secure the second end of each of the strings, the string anchors each defining an aperture;

wherein the first end of each of the strings pass through respective openings in the headstock and make physical contact with the headstock in the openings, the second end of each of the strings being secured in the aperture of the string anchors.

22. The stringed musical instrument as claimed in claim 21, wherein the strings each comprise an anchor fitting disposed on the first end for securing the strings in the respective openings in the headstock.

23. The stringed musical instrument as claimed in claim 21, comprising a bridge disposed on the instrument body forward of the tuning and clamping device and supporting the strings on the instrument body.

24. The stringed musical instrument as claimed in claim 21, comprising a tone control bar disposed on the instrument body forward of the tuning and clamping device and overlapping the strings on the instrument body.

25. The stringed musical instrument as claimed in claim 21, wherein the forward-backward positioning of the string anchors in the recess is adjustable to allow for a change in string tension.

26. The stringed musical instrument as claimed in claim 1, wherein the respective openings in the headstock form an angle of about 30°-90° with the headstock.

27. The stringed musical instrument of claim 26, wherein the angle is approximately 60°.

* * * * *